US007254238B2

(12) United States Patent
Chareyron

(10) Patent No.: US 7,254,238 B2
(45) Date of Patent: Aug. 7, 2007

(54) METHOD AND CIRCUIT FOR HEADSET LISTENING OF AN AUDIO RECORDING

(75) Inventor: Valentin Chareyron, Yverdon (CH)

(73) Assignee: Yellowknife A.V.V., N-L-Oranjestad (AW)

( * ) Notice: Subject to any disclaimer, the term of this patent is extended or adjusted under 35 U.S.C. 154(b) by 540 days.

(21) Appl. No.: 10/475,194

(22) PCT Filed: Apr. 5, 2002

(86) PCT No.: PCT/CH02/00192

§ 371 (c)(1),
(2), (4) Date: Oct. 18, 2003

(87) PCT Pub. No.: WO02/085067

PCT Pub. Date: Oct. 24, 2002

(65) Prior Publication Data

US 2004/0146166 A1 Jul. 29, 2004

(30) Foreign Application Priority Data

Apr. 17, 2001 (EP) ..... 01810373

(51) Int. Cl.
*H04R 5/00* (2006.01)

(52) U.S. Cl. ..... 381/1; 381/17; 381/309

(58) Field of Classification Search ..... 381/26
See application file for complete search history.

(56) References Cited

U.S. PATENT DOCUMENTS 4,118,599 A * 10/1978 Iwahara et al. ..... 381/1
4,359,605 A 11/1982 Haramoto et al.
4,910,779 A * 3/1990 Cooper et al. ..... 381/26
5,033,086 A 7/1991 Fidi
5,105,462 A * 4/1992 Lowe et al. ..... 381/17
5,371,799 A 12/1994 Lowe et al.
5,381,482 A * 1/1995 Matsumoto et al. ..... 381/18

(Continued)

FOREIGN PATENT DOCUMENTS

DE 32 33 990 3/1984

(Continued)

*Primary Examiner*—Xu Mei
(74) *Attorney, Agent, or Firm*—Townsend M. Belser, Jr.; Nexsen Pruet Adams Kleemeter, LLC

(57) ABSTRACT

The invention concerns a circuit for adapting the signals from different channels (L, R) delivered by an audio reproduction system (10) in conditions specific to headset listening. It comprises: means (14*a*) for producing a left-channel intermediate signal resulting from the addition of at least a signal addressed to the left channel (L) to at least one signal addressed to the right channel (R) delayed by a first time interval, and a right channel intermediate signal (R1) resulting from the addition of the signal addressed to the right channel (R) to the signal addressed to the left channel (L) delayed by the same time interval, and means (14*b*) for producing an adapted left channel signal (Lc) resulting from the addition of the left channel intermediate signal (L1) to the right channel intermediate signal (R1) delayed by a second time interval and an adapted right channel signal (Rc) resulting from the addition of the right channel intermediate signal (R1) to the left channel intermediate signal (L1) delayed by the same time interval.

16 Claims, 2 Drawing Sheets

Figure 1:
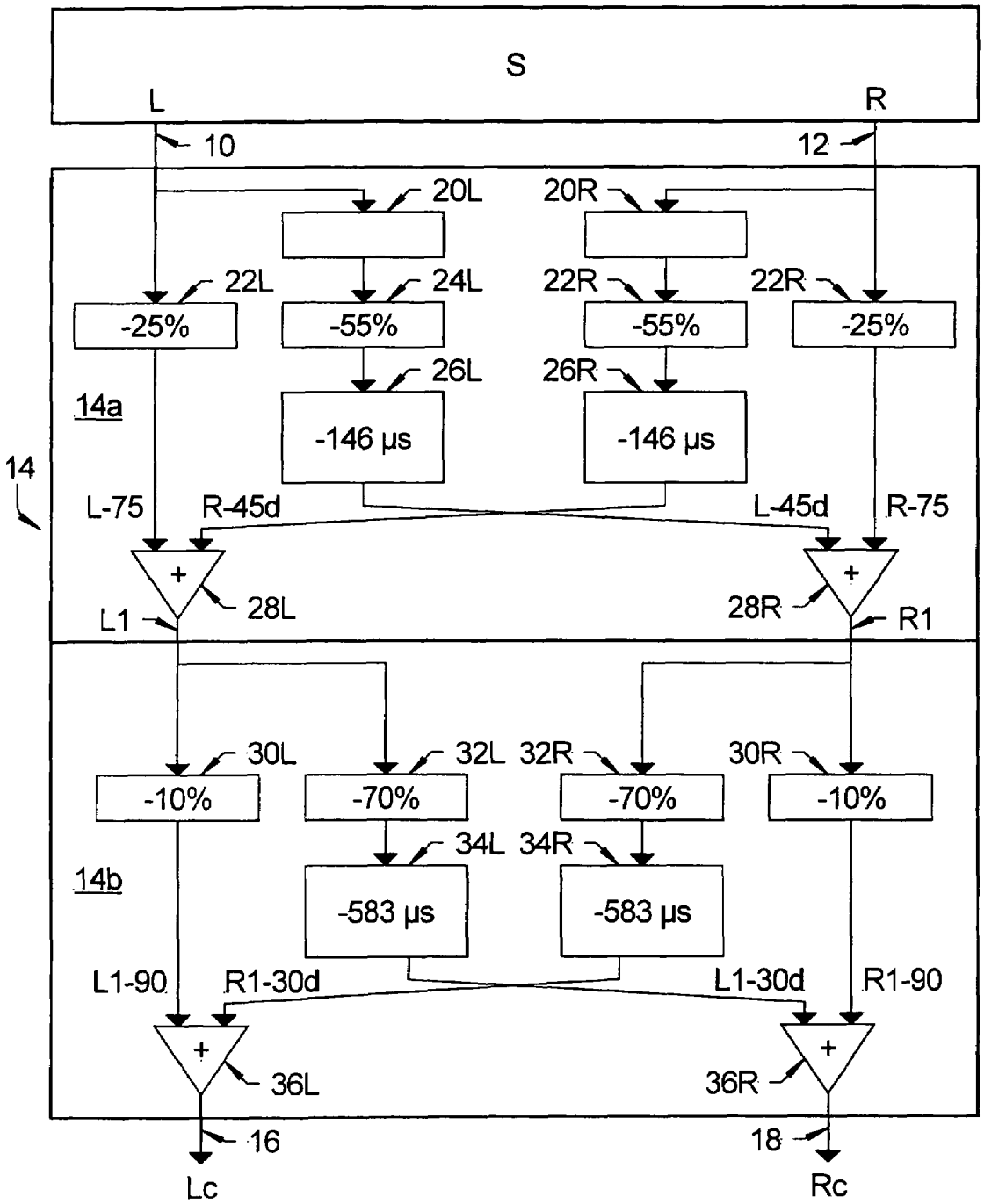

U.S. PATENT DOCUMENTS 5,579,396 A * 11/1996 Iida et al. ..... 381/18
5,761,315 A * 6/1998 Iida et al. ..... 381/18
5,844,993 A * 12/1998 IIda et al. ..... 381/18
5,999,630 A * 12/1999 Iwamatsu ..... 381/17
6,021,205 A * 2/2000 Yamada et al. ..... 381/310
6,067,360 A * 5/2000 Kasai et al. ..... 381/1
6,078,669 A 6/2000 Maher
6,449,368 B1 * 9/2002 Davis et al. ..... 381/1
6,850,621 B2 * 2/2005 Sotome et al. ..... 381/17
6,968,062 B1 * 11/2005 Inanaga ..... 381/2
6,975,731 B1 * 12/2005 Cohen et al. ..... 381/74
7,076,068 B2 * 7/2006 Sotome et al. ..... 381/17
7,082,201 B2 * 7/2006 Sotome et al. ..... 381/17

FOREIGN PATENT DOCUMENTS

| | | |
|---|---|---|
| GB | 2220818 | 1/1990 |
| JP | 64-19900 | 1/1989 |
| JP | 11205892 | 7/1999 |
| WO | 9859525 | 12/1998 |

* cited by examiner

METHOD AND CIRCUIT FOR HEADSET LISTENING OF AN AUDIO RECORDING

The present invention pertains to electronic devices intended for sound reproduction. It relates, more particularly, to a method and a circuit that are specially designed to adapt the signals of the various channels delivered by an audio reproduction system to the specific conditions of their headset listening.

The invention applies equally to the processing of right channel and left channel signals of a stereophonic reproduction system as to that of the signals of the channels of a multi-channel system such as, for example, the system known as "Surround".

The existing audio reproduction systems are designed for listening with one enclosure per channel, arranged appropriately in a location. In the case of a stereophonic system, the two enclosures are ideally situated at the base of an equilateral triangle, a vertex of which is occupied by the listener.

Now, during headset listening, the two headphones are arranged in the immediate vicinity of the ears of the listener. His brain will thus simply perceive the sound sources reproduced on a line passing through his head from one ear to the other, completely ignoring an essential element of the audio reproduction pathway, namely the volume of air situated between each enclosure and the listener. This therefore does not correspond to the conditions of listening via enclosures and does not allow correct reproduction of the sound image.

Specifically, if the signal transmission medium does indeed involve just one channel per channel to be reproduced (two channels in stereo), the reproduction method itself utilizes, in fact, two paths per channel, i.e. the direct path, from the enclosure to the closer ear, and the indirect path, from the enclosure to the more distant ear (four paths in stereo).

Obviously, the sounds from the indirect paths have longer journeys and are therefore perceived with a certain delay. To fix matters, in the case of a stereophonic signal, the difference in journey length is around 7 cm, giving rise to a phase shift of 206 μs.

This is why headset listening that takes no account of the indirect paths deprives the brain of the information it needs in order to reconstruct the sound image.

The aim of the present invention is to provide a method and a circuit that afford optimal listening conditions for headset listening.

More precisely, the invention relates to a method of adapting the signals of the various channels delivered by an audio reproduction system to the specific conditions of their headset listening, characterized in that it consists:

- in adding to at least one signal intended for the left channel at least one signal intended for the right channel delayed by a first time interval so as to obtain an intermediate left channel signal, and to said signal intended for the right channel said signal intended for the left channel delayed by the same time interval so as to obtain an intermediate right channel signal; then
- in adding to the intermediate left channel signal the intermediate right channel signal delayed by a second time interval, so as to obtain a left channel signal adapted to the headset, and to the intermediate right channel signal the intermediate left channel signal delayed by the same time interval, so as to obtain a right channel signal adapted to the headset.

Advantageously, when the method is applied to a stereophonic reproduction system delivering a left channel signal and a right channel signal only, the first delay is between 100 and 200 μs, and the second delay between 500 and 700 μs.

According to a preferred embodiment, said delayed signal intended for the left channel and said delayed signal intended for the right channel are previously filtered in a way which favors the low frequencies at the expense of the high ones. Typically, the filtering action is zero at 0 Hz and total at 24 kHz.

Preferably:

- said signal intended for the left channel and said signal intended for the right channel previously undergo a first attenuation; and
- said delayed signal intended for the left channel and said delayed signal intended for the right channel previously undergo a second attenuation.

In the case of a stereophonic reproduction system, the first attenuation is advantageously between 20 and 30%, and the second attenuation between 50 and 60%.

Preferably, also:

- the intermediate left channel signal and the intermediate right channel signal previously undergo a first attenuation; and
- the delayed intermediate left channel signal and the delayed intermediate right channel signal previously undergo a second attenuation.

In the case of a stereophonic reproduction system, the first attenuation is between 5 and 15%, and the second attenuation between 65 and 75%.

The invention also relates to a circuit for the implementation of the method as described above, characterized in that it comprises:

- first means for producing an intermediate left channel signal resulting from the addition of at least one signal intended for the left channel to at least one signal intended for the right channel delayed by a first time interval, and an intermediate right channel signal resulting from the addition of said signal intended for the right channel to said signal intended for the left channel delayed by the same time interval, and
- second means for producing a left channel signal adapted to the headset resulting from the addition of the intermediate left channel signal to the intermediate right channel signal delayed by a second time interval, and a right channel signal adapted to the headset resulting from the addition of the intermediate right channel signal to the intermediate left channel signal delayed by the same time interval.

Figure 2:
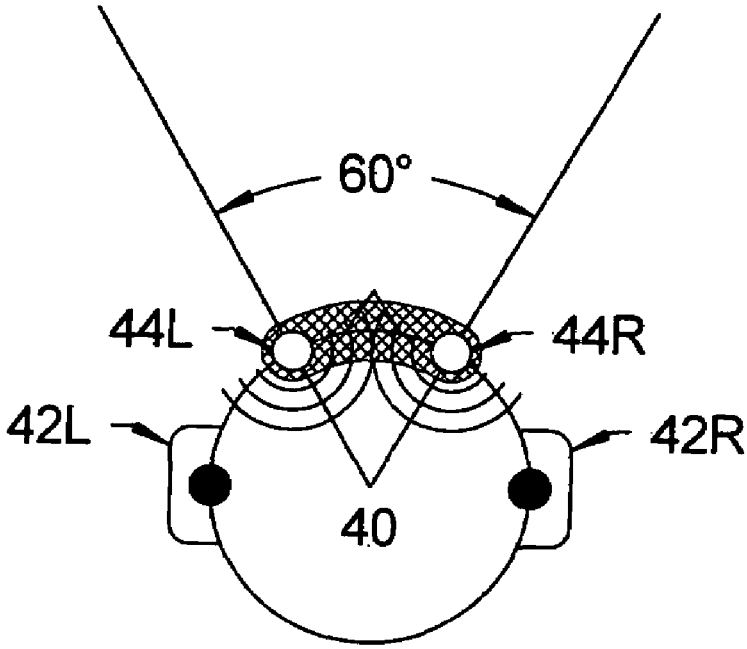
Figure 3:
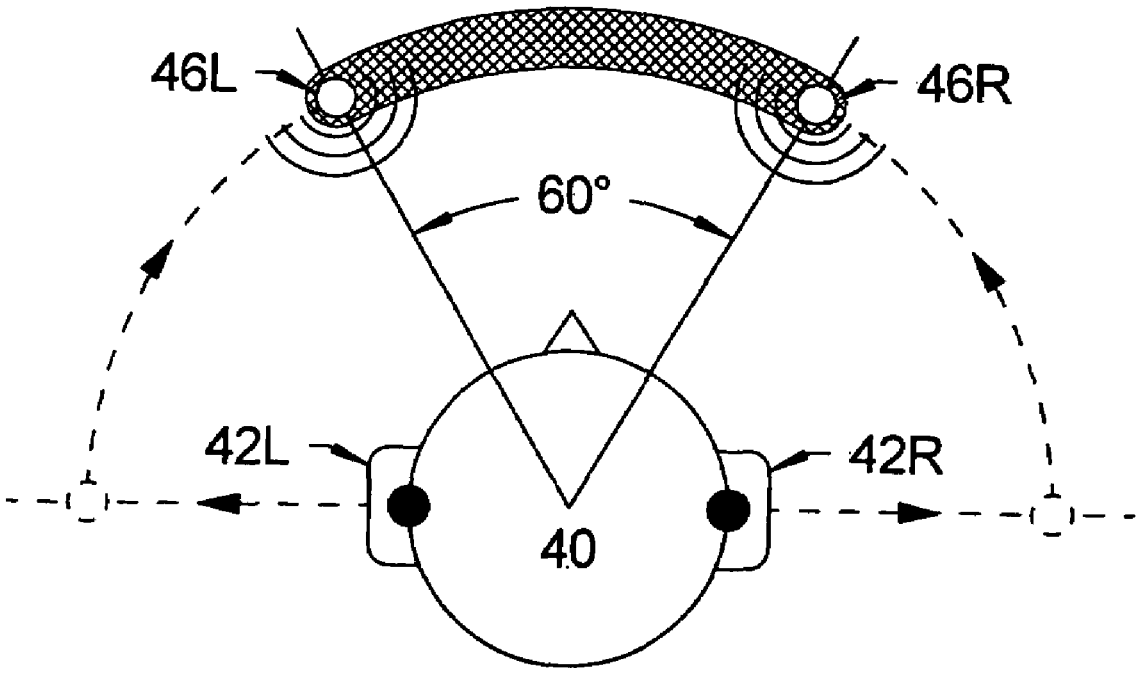

Other characteristics of the invention will emerge from the description which follows, given with regard to the appended drawings, in which:

FIG. 1 represents a circuit according to the invention, intended for the adaptation of the signals of a stereophonic source, and FIGS. 2 and 3 serve to explain its effects.

Represented diagrammatically in FIG. 1 is a stereophonic audio source S, of conventional type, whose two outputs 10 and 12 respectively deliver the signal of the left channel L and the signal of the right channel R.

These signals are applied to the two inputs of a circuit 14 with two stages 14*a* and 14*b*, the subject of the present invention, whose function is to process them with a view to delivering, on its respective outputs 16 and 18, optimized left channel Lc and right channel Rc signals with a view to headset listening.

In the mode of implementation of the invention as described here by way of example, the circuit 14 is, in fact, a microprocessor. Consequently, it goes without saying that the signals L and R applied to its inputs are in digital form. The description of the processing of these signals will therefore be referred to operations and not to electronic components. The reference numbers of these operations will be assigned the letter L when dealing with the left channel and the letter R when dealing with the right channel.

The first operations performed on the signals L and R are, on the one hand, at 20, their passing through a low-pass filter and, on the other hand, at 22, their attenuation by 25%.

A filtering operation carried out at 20 is aimed at favoring the low frequencies at the expense of the high ones. This action is not indispensable but it helps to improve the sought-after effect. Typically, the action of the filter is zero at 0 Hz and then increases progressively up to 24 kHz, the frequency for which its action is total.

The two filtered signals then undergo, at 24, an attenuation of 55% and are then delayed, at 26, by 146 μs. For a sampling frequency of 48 kHz, this delay corresponds to a shift of seven samples of the signals.

The signal R-45*d*, thus attenuated to 45% of its initial level and delayed by 146 μs, is then added, at 28L to the signal L-75 attenuated to 75% of its initial level, but not delayed, so as to obtain a composite intermediate left channel signal L1.

In parallel and in identical manner, the signal L-45*d*, attenuated to form 45% of its initial level and delayed by 146 μs, is added, at 28R, to the signal R-75 attenuated to 75% of its initial level, but not delayed, so as to obtain a composite intermediate right channel signal R1.

The operations 22 to 28 just described are performed in stage 14*a*.

The subsequent operations are, for the signals L1 and R1, on the one hand, at 30, an attenuation by 10% and, on the other hand, at 32, an attenuation by 70% followed, at 34, by a delay by 583 μs. For the previously mentioned sampling frequency of 48 kHz, this delay corresponds to a shift of 28 samples of the signals.

The signal R1-30*d*, thus attenuated to 30% of its initial level and delayed by 583 μs, is then added, at 36L, to the signal L1-90 attenuated to 90% of its initial level, but not delayed, so as to obtain a composite signal Lc which appears on the output 16 and constitutes the signal of the left channel intended for headset listening.

In parallel and in an identical manner, the signal L1-30*d*, attenuated to 30% of its initial level and delayed by 583 μs, is added, at 36R to the signal R1-90 attenuated to 90% of its initial level, but not delayed, so as to obtain a composite signal Rc which appears on the output 20 and constitutes the signal of the right channel intended for headset listening.

The operations 30 to 36 are performed in stage 14*b*.

It is thus apparent that the circuit according to the invention undertakes two successive processings of the signals, i.e. the transformation of the starting signals L and R into signals L1 and R1 (stage 14*a*), then the transformation of the latter signals into signals Lc and Rc (stage 14*b*). In the subsequent description, these two processings will be designated azimuthing and externalization respectively.

Reference will now be made to FIGS. 2 and 3 which respectively show the effect of the azimuthing and that of the externalization. These figures represent the head 40 of a wearer of a headset whose left and right headphones are designated by the references 42L and 42R.

It will be recalled that after the azimuthing processing (stage 14*a*):

the signal L1 results from the addition of the signal L attenuated by 25% to the signal R attenuated by 55% and delayed by 146 μs;

the signal R1 results from the addition of the signal R attenuated by 25% to the signal L attenuated by 55% and delayed by 146 μs.

The result of the azimuthing processing of the signals L and R is, as shown in FIG. 2, to substitute for the two physical sound sources constituted by the headphones 42L and 42R, two virtual sound sources 44L and 44R positioned in front of the eyes of the wearer of the headset, at the vertices of the base of an equilateral triangle whose opposite side is substantially situated between the two ears.

Thus, the stereophonic image perceived by the listener spans 60°, this corresponding to the conditions, generally accepted as the most comfortable, of listening via enclosures.

However, as is apparent in FIG. 2, the virtual sources 44L and 44R still remain very close to the brow of the wearer of the headset, this not affording him optimal listening comfort.

The externalization processing of the signals L1 and R1, that have just undergone the azimuthing processing, is aimed precisely at correcting this effect.

It will be recalled here that after the externalization processing:

the signal Lc results from the addition of the signal L1 attenuated by 10% to the signal R1 attenuated by 70% and delayed by 583 μs;

the signal Rc results from the addition of the signal R1 attenuated by 10% to the signal L1 attenuated by 70% and delayed by 583 μs.

The result of the externalization processing of the signals L1 and R1 is, as shown by FIG. 3, to make the two virtual sound sources 44L and 44R further from the brow of the listener and to replace them with the sources 46L and 46R.

Numerous trials have shown that the 583 μs shift imposed on the signals L1 and D1 corresponds to optimal listening conditions as regards positioning of the virtual sources 46L and 46R at a distance from the vertex of the equilateral triangle around three times greater than the distance that they occupied. Depending on the sensitivities of the listeners, an identical effect may be obtained with a shift of between roughly 500 and 700 μs, which therefore offers the greatest possible externalization with the greatest number of recordings.

As far as the shift imposed on the signals L and D during the azimuthing processing is concerned, given that the externalization gives the sensation of widening the stereo base by around three times, it seemed logical to adopt a phase shift producing an angle around three times smaller than when there is no externalization. The trials performed have shown that the value of 146 μs makes it possible, given the externalization, to provide a stereo image over around 60° with the largest number of recordings. Of course, depending on the sensitivities of the listeners, an identical effect can be obtained with a shift of between roughly 100 and 200 μs.

Thus, by virtue of the successive azimuthing and externalization processings, the sound sources are no longer simply in the ears of the wearer of the headset, whose head they then pass through without managing to generate the desired stereophonic image, but they are displaced in front of him, at a distance and at an angle that afford him satisfactory stereophonic listening conditions.

The present description has been given while referring to attenuations of the signals which, in the case of stereophonic listening, make it possible to preserve a degree of balance at the output. It goes without saying that these values have been given merely by way of example and that they may be modified by the listener depending on his sensitivity. The same holds for the shift values of the signals which determine the optimum angle of the sound emissions of the two virtual sources. A modification of these values by the wearer of the headset allows him to create the listening conditions which suit him best.

As already mentioned, the invention is not limited to the adaptation, for headset listening, of the signals delivered by a stereophonic system (a left channel signal and a right channel signal). It is also usable for processing the signals of the various channels of a multi-channel system. In this case, it simply suffices, after having chosen the channels that will go to the left ear and those that will go to the right ear, to perform, in the stage 16*a:* the addition, to the signals intended for the left ear, of the signals, delayed, intended for the right ear, and the addition, to the signals intended for the right ear, of the signals, delayed, intended for the left ear.

It will be noted, in conclusion, that the invention applies, generally, to any headset listening, whether it be concerned, in particular, with listening to music or with being able to better distinguish, in an aircraft cockpit, between the various sources of messages. The invention may also find a beneficial application in the field of orthophony by allowing customization of the amplification of sound signals so as to compensate for certain hearing deficiencies.

The invention claimed is:

1. A method of adapting the signals of the various channels (L, R) delivered by an audio reproduction system (10) to the specific conditions of a listener's headset listening, characterized in that it consists of:

adding to at least one signal intended for the left channel (L) at least one signal intended for the right channel (R) delayed by a first time interval so as to obtain an intermediate left channel signal (L1), and adding to said signal intended for the right channel (R) said signal intended for the left channel (L) delayed by the same time interval so as to obtain an intermediate right channel signal (R1); then adding to the intermediate left channel signal (L1) the intermediate right channel signal (R1) delayed by a second time interval, so as to obtain a left channel signal adapted to the headset (Lc), and adding to the intermediate right channel signal (R1) the intermediate left channel signal (L1) delayed by the same time interval, so as to obtain a right channel signal adapted to the headset (Rc).

2. The method as claimed in claim 1, characterized in that, in the case of a stereophonic reproduction system delivering a left channel signal (L) and a right channel signal (R), the first delay is between 100 and 200 μs, and the second delay is between 500 and 700 μs.

3. The method as claimed in claim 1, characterized in that said delayed signal intended for the left channel and said delayed signal intended for the right channel are previously filtered in a way which favors the low frequencies at the expense of the high ones.

4. The method as claimed in claim 3, characterized in that the filtering action is zero at 0 Hz and total at 24 kHz.

5. The method as claimed in claim 1, characterized in that:

said signal intended for the left channel and said signal intended for the right channel previously undergo a first attenuation; and said delayed signal intended for the left channel and said delayed signal intended for the right channel previously undergo a second attenuation.

6. The method as claimed in claim 5, characterized in that, in the case of a stereophonic reproduction system, the first attenuation is between 20 and 30%, and the second attenuation between 50 and 60%.

7. The method as claimed in claim 1, characterized in that, the intermediate left channel signal and the intermediate right channel signal previously undergo a first attenuation; and the delayed intermediate left channel signal (Lc) and the delayed intermediate right channel (Rc) signal previously undergo a second attenuation.

8. The method as claimed in claim 7, characterized in that, in the case of a stereophonic reproduction system, the first attenuation is between 5 and 15%, and the second attenuation between 65 and 75%.

9. A circuit for the implementation of the method as claimed in claim 1, characterized in that it comprises:

first means (14*a*) for producing an intermediate left channel signal (L1) resulting from the addition of at least one signal for the left channel (L) to at least one signal intended for the right channel (R) delayed by a first time interval, and an intermediate right channel signal (R1) resulting from the addition of said signal intended for the right channel (R) to said signal intended for the left channel (L) delayed by the same time interval, and second means (14*b*) for producing a left channel signal adapted to the headset (Lc) resulting from the addition of the intermediate left channel signal (L1) to the intermediate right channel signal (R1) delayed by a second time interval, and a right channel signal (R1) adapted to the headset (Rc) resulting from the addition of the intermediate right channel signal (R1) to the intermediate left channel signal (L1) delayed by the same time interval.

10. A circuit for the implementation of the method as claimed in claim 2, characterized in that it comprises:

first means (14*a*) for producing an intermediate left channel signal (L1) resulting from the addition of at least one signal for the left channel (L) to at least one signal intended for the right channel (R) delayed by a first time interval, and an intermediate right channel signal (R1) resulting from the addition of said signal intended for the right channel (R) to said signal intended for the left channel (L) delayed by the same time interval, and second means (14*b*) for producing a left channel signal adapted to the headset (Lc) resulting from the addition of the intermediate left channel signal (L1) to the intermediate right channel signal (R1) delayed by a second time interval, and a right channel signal (R1) adapted to the headset (Rc) resulting from the addition of the intermediate right channel signal (R1) to the intermediate left channel signal (L1) delayed by the same time interval.

11. A circuit for the implementation of the method as claimed in claim 3, characterized in that it comprises:

first means (14*a*) for producing an intermediate left channel signal (L1) resulting from the addition of at least one signal for the left channel (L) to at least one signal intended for the right channel (R) delayed by a first time interval, and an intermediate right channel signal (R1) resulting from the addition of said signal intended for the right channel (R) to said signal intended for the left channel (L) delayed by the same time interval, and second means (14*b*) for producing a left channel signal adapted to the headset (Lc) resulting from the addition of the intermediate left channel signal (L1) to the intermediate right channel signal (R1) delayed by a second time interval, and a right channel signal (R1) adapted to the headset (Rc) resulting from the addition of the intermediate right channel signal (R1) to the intermediate left channel signal (L1) delayed by the same time interval.

12. A circuit for the implementation of the method as claimed in claim 4, characterized in that it comprises:

first means (14*a*) for producing an intermediate left channel signal (L1) resulting from the addition of at least one signal for the left channel (L) to at least one signal intended for the right channel (R) delayed by a first time interval, and an intermediate right channel signal (R1) resulting from the addition of said signal intended for the right channel (R) to said signal intended for the left channel (L) delayed by the same time interval, and second means (14*b*) for producing a left channel signal adapted to the headset (Lc) resulting from the addition of the intermediate left channel signal (L1) to the intermediate right channel signal (R1) delayed by a second time interval, and a right channel signal (R1) adapted to the headset (Rc) resulting from the addition of the intermediate right channel signal (R1) to the intermediate left channel signal (L1) delayed by the same time interval.

13. A circuit for the implementation of the method as claimed in claim 5, characterized in that it comprises:

first means (14*a*) for producing an intermediate left channel signal (L1) resulting from the addition of at least one signal for the left channel (L) to at least one signal intended for the right channel (R) delayed by a first time interval, and an intermediate right channel signal (R1) resulting from the addition of said signal intended for the right channel (R) to said signal intended for the left channel (L) delayed by the same time interval, and second means (14*b*) for producing a left channel signal adapted to the headset (Lc) resulting from the addition of the intermediate left channel signal (L1) to the intermediate right channel signal (R1) delayed by a second time interval, and a right channel signal (R1) adapted to the headset (Rc) resulting from the addition of the intermediate right channel signal (R1) to the intermediate left channel signal (L1) delayed by the same time interval.

14. A circuit for the implementation of the method as claimed in claim 6, characterized in that it comprises:

first means (14*a*) for producing an intermediate left channel signal (L1) resulting from the addition of at least one signal for the left channel (L) to at least one signal intended for the right channel (R) delayed by a first time interval, and an intermediate right channel signal (R1) resulting from the addition of said signal intended for the right channel (R) to said signal intended for the left channel (L) delayed by the same time interval, and second means (14*b*) for producing a left channel signal adapted to the headset (Lc) resulting from the addition of the intermediate left channel signal (L1) to the intermediate right channel signal (R1) delayed by a second time interval, and a right channel signal (R1) adapted to the headset (Rc) resulting from the addition of the intermediate right channel signal (R1) to the intermediate left channel signal (L1) delayed by the same time interval.

15. A circuit for the implementation of the method as claimed in claim 7, characterized in that it comprises:

first means (14*a*) for producing an intermediate left channel signal (L1) resulting from the addition of at least one signal for the left channel (L) to at least one signal intended for the right channel (R) delayed by a first time interval, and an intermediate right channel signal (R1) resulting from the addition of said signal intended for the right channel (R) to said signal intended for the left channel (L) delayed by the same time interval, and second means (14*b*) for producing a left channel signal adapted to the headset (Lc) resulting from the addition of the intermediate left channel signal (L1) to the intermediate right channel signal (R1) delayed by a second time interval, and a right channel signal (R1) adapted to the headset (Rc) resulting from the addition of the intermediate right channel signal (R1) to the intermediate left channel signal (L1) delayed by the same time interval.

16. A circuit for the implementation of the method as claimed in claim 8, characterized in that it comprises:

first means (14*a*) for producing an intermediate left channel signal (L1) resulting from the addition of at least one signal for the left channel (L) to at least one signal intended for the right channel (R) delayed by a first time interval, and an intermediate right channel signal (R1) resulting from the addition of said signal intended for the right channel (R) to said signal intended for the left channel (L) delayed by the same time interval, and second means (14*b*) for producing a left channel signal adapted to the headset (Lc) resulting from the addition of the intermediate left channel signal (L1) to the intermediate right channel signal (R1) delayed by a second time interval, and a right channel signal (R1) adapted to the headset (Rc) resulting from the addition of the intermediate right channel signal (R1) to the intermediate left channel signal (L1) delayed by the same time interval.

* * * * *